US007911486B2

(12) United States Patent
Fan Chiang et al.

(10) Patent No.: US 7,911,486 B2
(45) Date of Patent: Mar. 22, 2011

(54) METHOD AND DEVICE FOR IMAGES BRIGHTNESS CONTROL, IMAGE PROCESSING AND COLOR DATA GENERATION IN DISPLAY DEVICES

(75) Inventors: Kuan-Hsu Fan Chiang, Tainan County (TW); Bing-Jei Liao, Tainan County (TW)

(73) Assignee: Himax Display, Inc., Tainan County (TW)

( * ) Notice: Subject to any disclaimer, the term of this patent is extended or adjusted under 35 U.S.C. 154(b) by 1133 days.

(21) Appl. No.: 11/554,436

(22) Filed: Oct. 30, 2006

(65) Prior Publication Data

US 2008/0100644 A1 May 1, 2008

(51) Int. Cl.
*G09G 5/10* (2006.01)

(52) U.S. Cl. ..... 345/690

(58) Field of Classification Search ..... 345/77–89, 345/690, 581–605; 348/222.1–223.1; 382/166–167
See application file for complete search history.

(56) References Cited

U.S. PATENT DOCUMENTS

| | | | | |
|---|---|---|---|---|
| 5,929,843 | A * | 7/1999 | Tanioka | 345/600 |
| 6,724,934 | B1 | 4/2004 | Lee et al. | |
| 6,876,764 | B2 | 4/2005 | Lee et al. | |
| 7,031,516 | B2 * | 4/2006 | Niko | 382/167 |
| 7,061,528 | B1 * | 6/2006 | Honma | 348/222.1 |
| 7,301,516 | B2 * | 11/2007 | Baek | 345/87 |
| 7,522,172 | B2 * | 4/2009 | Tanase et al. | 345/603 |
| 2003/0165266 | A1 * | 9/2003 | Kagawa et al. | 382/166 |
| 2005/0237288 | A1 * | 10/2005 | Yoshinaga et al. | 345/88 |
| 2007/0046793 | A1 * | 3/2007 | Sudo | 348/256 |

* cited by examiner

*Primary Examiner* — Sumati Lefkowitz
*Assistant Examiner* — Rodney Amadiz
(74) *Attorney, Agent, or Firm* — J.C. Patents

(57) ABSTRACT

The present invention is directed to methods and devices to increase the brightness of images in display devices. A white signal component is generated according to an input color signal, comprising primary signal components Red, Green and Blue. The generated white signal component and the primary signal components will be manipulated by methods and devices disclosed in the invention to generate adjusted primary signal components. Then the white signal component and the adjusted primary signal components will form a display signal for displaying brightness controlled images. Compared with the input color signal, the brightness of the display signal is increased while the color saturation thereof is almost kept.

12 Claims, 4 Drawing Sheets

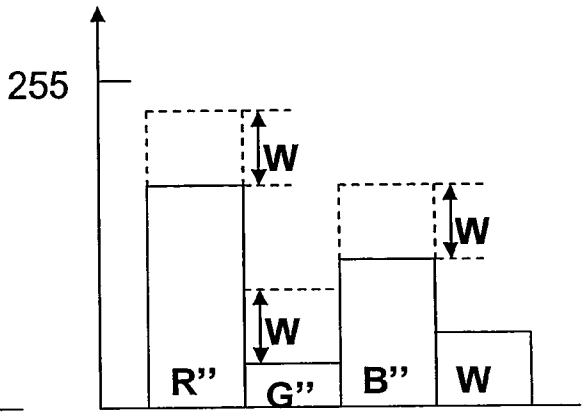
FIG. 4a
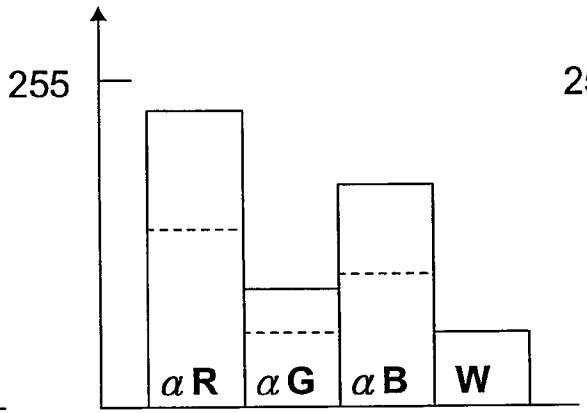
FIG. 4b
FIG. 4c

METHOD AND DEVICE FOR IMAGES BRIGHTNESS CONTROL, IMAGE PROCESSING AND COLOR DATA GENERATION IN DISPLAY DEVICES

BACKGROUND OF THE INVENTION

1. Field of Invention

The present invention relates to methods and devices for image processing and more particularly, to methods and devices for brightness control of images in display devices.

2. Description of Related Art

In a color display monitor or a color television, if a flat-panel display is used, it is easier to increase the screen size. But the brightness of displayed images is decreased in comparison with the use of a cathode-ray tube. To overcome such a drawback, a four-color output device in which a white color component is added to the three primary colors of RGB (Red, Green, and Blue) is employed. The white color component can be obtained by having a white light transmitted or reflected onto a white filter, which increases the overall brightness of the images in display devices.

A side effect of adding the white color component to the original three primary colors to increase the brightness of images is the decrease in color saturation. To overcome the side effect, the original three primary colors need to be adjusted, so that when these adjusted RGB colors and the white color component are outputted together, the brightness can be increased while the color saturation is almost kept.

SUMMARY OF THE INVENTION

Accordingly, one of the aspects of the invention is to provide methods to increase the brightness of images in display devices while the color saturation is almost kept.

Another aspect of the invention is to provide image processing devices to increase the brightness of images in display devices while the color saturation is almost kept.

The present invention is directed to methods and devices to increase the brightness of images in display devices. A white signal component is generated first according to an input color signal, comprising primary signal components Red, Green and Blue. The primary signal components, which carry image data, are inputted from an external device, such as a host computer, pixel by pixel. The generated white signal component and the primary signal components will be manipulated by methods and devices disclosed in the invention to generate adjusted primary signal components. Then the white signal component and the adjusted primary signal components will form a display signal for displaying brightness controlled images. Compared with the input color signal, the brightness of the display signal is increased while the color saturation thereof is almost kept.

A method for controlling brightness of an image comprises steps of: determining a coefficient; generating a white signal component from an input color signal; suppressing the input color signal according to the coefficient and the white signal component, to generate adjusted primary signal components of a display signal; and displaying a brightness controlled color image according to the display signal, which further comprises the white signal component; wherein the coefficient affects brightness of the brightness controlled color image.

Another method for controlling brightness of an image comprises steps of: generating a conversion parameter from primary signal components of an input color signal; generating a white signal component according to the primary signal components; generating adjusted primary signal components of a display signal according to the conversion parameter, the white signal component and the primary signal components; and displaying a brightness controlled color image according to the display signal, which further comprises the white signal component.

An image processing device related to the invention comprises: a detector, generating a white signal component according to primary signal components of an input color signal; a multiplier, multiplying the white signal component with a coefficient to produce a multiplication result; and a subtracting unit, subtracting the multiplication result from the primary signal components to generate adjusted primary signal components of a display signal, which further includes the white signal component.

Another image processing device related to the invention comprises: a detector, generating a white signal component from primary signal components of an input color signal; a non-linear converter, outputting a conversion parameter according to the primary signal components; a multiplying unit, multiplying the primary signal components with the conversion parameter to produce a multiplication result; and a subtracting unit, subtracting the white signal component from the multiplication result to generate adjusted primary signal components of a display signal, which further includes the white signal component.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIGS. 4*a*~4*c* show the input color signal (R/G/B) and the display signal (R"/G"/B"/W) in the image processing device in accordance with the second embodiment of the present invention.

DESCRIPTION OF THE PREFERRED EMBODIMENTS

Figure 1:
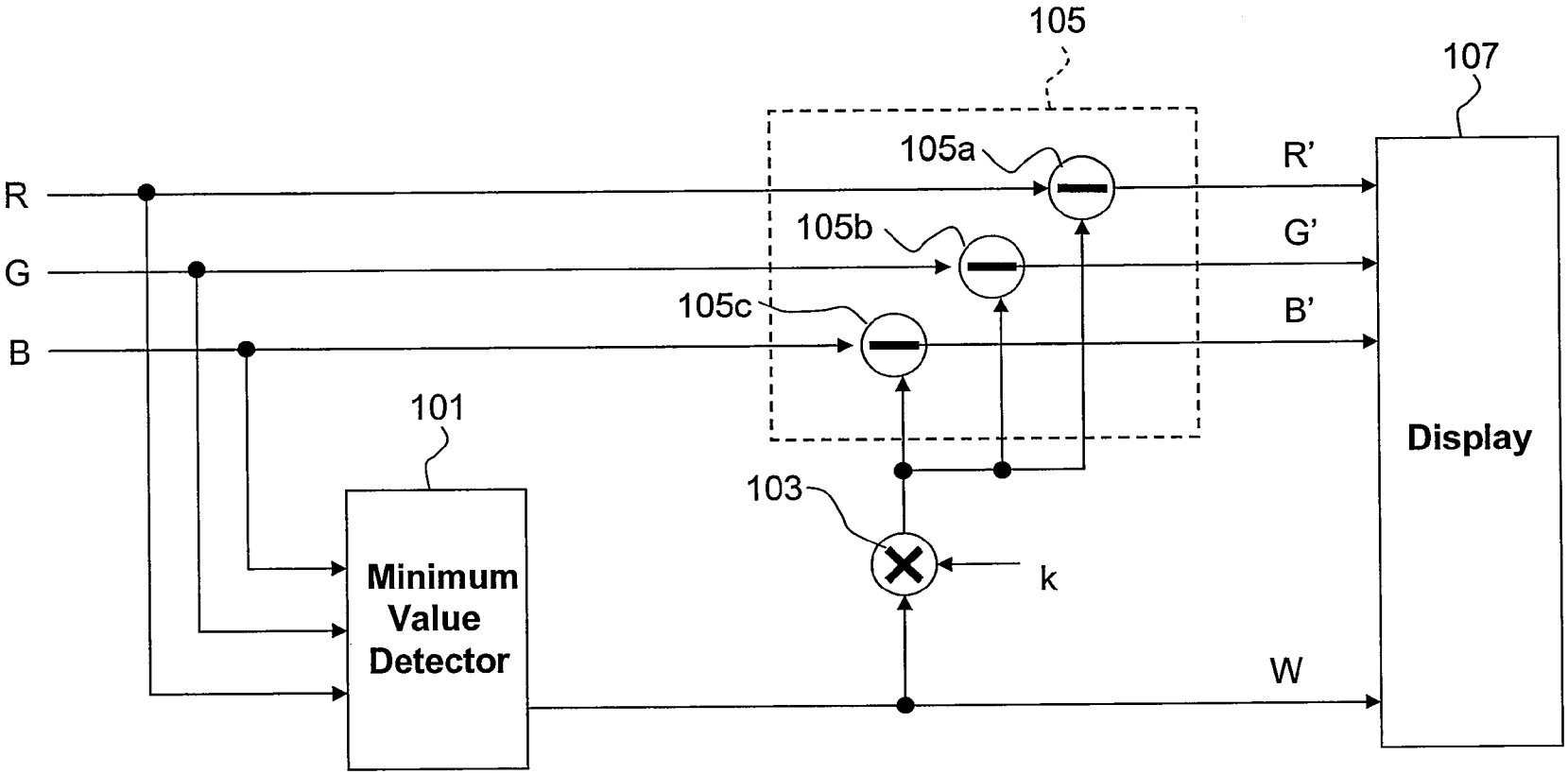
FIG. 1 is a block diagram of an image processing device in accordance with a first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

First Embodiment

FIG. 1 is a block diagram of an image processing device in accordance with a first embodiment of the present invention.

As shown in FIG. 1, the image processing device comprises a minimum value detector 101, a multiplier 103, and a subtracting unit 105. The subtracting unit 105 comprises three subtracters 105*a*~105*c*. An input color signal to the device includes primary signal components R (red), G (green) and B (blue).

The minimum value detector 101 finds the minimum value from the primary signal components and uses the minimum value to generate a white signal component W. For example, the value of the white signal component W may be equal to the minimum value.

The white signal component is multiplied by the multiplier 103 with a predetermined coefficient k to produce a multiplication result.

The subtracting unit 105 subtracts the multiplication result from the primary signal components to generate adjusted primary signal components R', G' and B'. Wherein the subtracter 105*a* subtracts the multiplication result from the primary signal component R to generate the adjusted primary signal component R'; the subtracter 105*b* subtracts the multiplication result from the primary signal component G to generate the adjusted primary signal component G'; and the subtracter 105*c* subtracts the multiplication result from the primary signal component B to generate the adjusted primary signal component B'. The adjusted primary signal components may be expressed by R'=R−kW, G'=G−kW, and B'=B−kW. Four signal components R', G', B' and W are sent, as a display signal, to a display 107.

TABLE 1 shows the experiment results of the above embodiment when different values of k are used and the comparison of brightness and chrominance of the display signal with the brightness and chrominance of the original input color signal.

TABLE 1

| k | White (WH) | Black (BL) | CR | WH'/WH | NTSC % CIE1976 (C) | C'/C |
|---|---|---|---|---|---|---|
| Display Signal (R'/G'/B'/W), k = 0.1 | 23.453 | 0.124 | 189.137 | 1.332 | 33.48 | 0.874 |
| Display Signal (R'/G'/B'/W), k = 0.2 | 22.677 | 0.143 | 158.580 | 1.288 | 33.22 | 0.867 |
| Display Signal (R'/G'/B'/W), k = 0.3 | 18.969 | 0.134 | 141.560 | 1.078 | 33.26 | 0.868 |
| Display Signal (R'/G'/B'/W), k = 0.4 | 18.198 | 0.142 | 128.155 | 1.034 | 33.29 | 0.869 |
| Input Color Signal (R/G/B) | 17.604 | 0.099 | 177.818 | 1 | 38.31 | 1 |

Wherein:
k: the predetermined coefficient;
White (WH): the brightness of a white image;
Black (BL): the brightness of a black image;
CR: contrast ratio of White (WH) to Black (BL), i.e. WH/BL;
WH'/WH: ratio of the brightness of the white image of the display signal to the input color signal;
NTSC % CIE1976 (C): the chrominance of a signal; and
C'/C: ratio of the chrominance of the display signal to the input color signal.

As seen from TABLE 1, by the above embodiment, the brightness of the display signal, comprising R', G', B' and W, is increased compared with the brightness of the input color signal, comprising only R, G and B, while the chrominance of the display signal may be kept to around 87% of the chrominance of the input color signal. When, for example, k is 0.1, the brightness of the white image of the display signal is 33% higher than the brightness of the white image of the input color signal.

Second Embodiment

Figure 2:
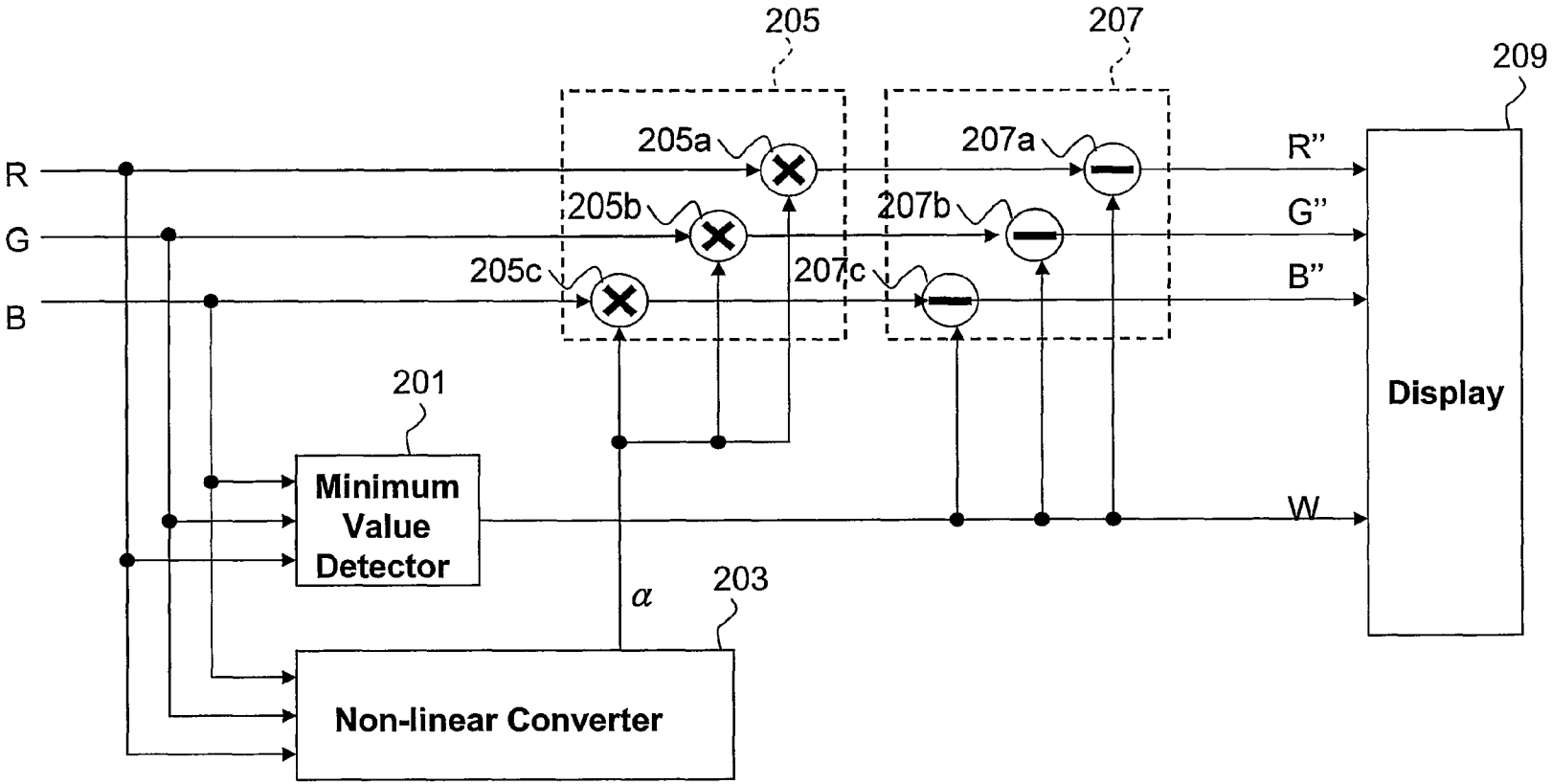
FIG. 2 is a block diagram of an image processing device with a non-linear converter in accordance with a second embodiment of the present invention.

FIG. 2 is a block diagram of an image processing device with a non-linear converter in accordance with a second embodiment of the present invention. As shown in FIG. 2, the image processing device comprises a minimum value detector 201, a non-linear converter 203, a multiplying unit 205, and a subtracting unit 207. The multiplying unit 205 comprises three multipliers 205*a*~205*c*. The subtracting unit 207 comprises three subtracters 207*a*~207*c*. The input color signal to the device includes primary signal components R (red), G (green) and B (blue).

The minimum value detector 201 finds the minimum value from the primary signal components and uses the value to generate the white signal component W. For example, the value of the white signal component W may be equal to the minimum value.

The non-linear converter 203 uses the primary signal components to generate a conversion parameter α.

The multiplying unit 205 multiplies the primary signal components with the conversion parameter α to produce multiplication results. Wherein the multiplier 205*a* multiplies the primary signal component R with the conversion parameter α to produce a multiplication result αR; the multiplier 205*b* multiplies the primary signal component G with the conversion parameter α to produce a multiplication result αG, and the multiplier 205*c* multiplies the primary signal component B with the conversion parameter α to produce a multiplication result αB.

The subtracting unit 207 subtracts the white signal component W from the multiplication results to generate the adjusted primary signal components R", G" and B". Wherein the subtracter 207*a* subtracts the white signal component W from the multiplication result αR to generate R"; the subtracter 207*b* subtracts the white signal component W from the multiplication result αG to generate G"; and the subtracter 207*c* subtracts the white signal component W from the multiplication result αB to generate B".

The adjusted primary signal components may be expressed by R"=αR−W, G"=αG−W, and B"=αB−W. Four signal components R", G", B" and W are sent, as a display signal, to a display 209.

Figure 3:
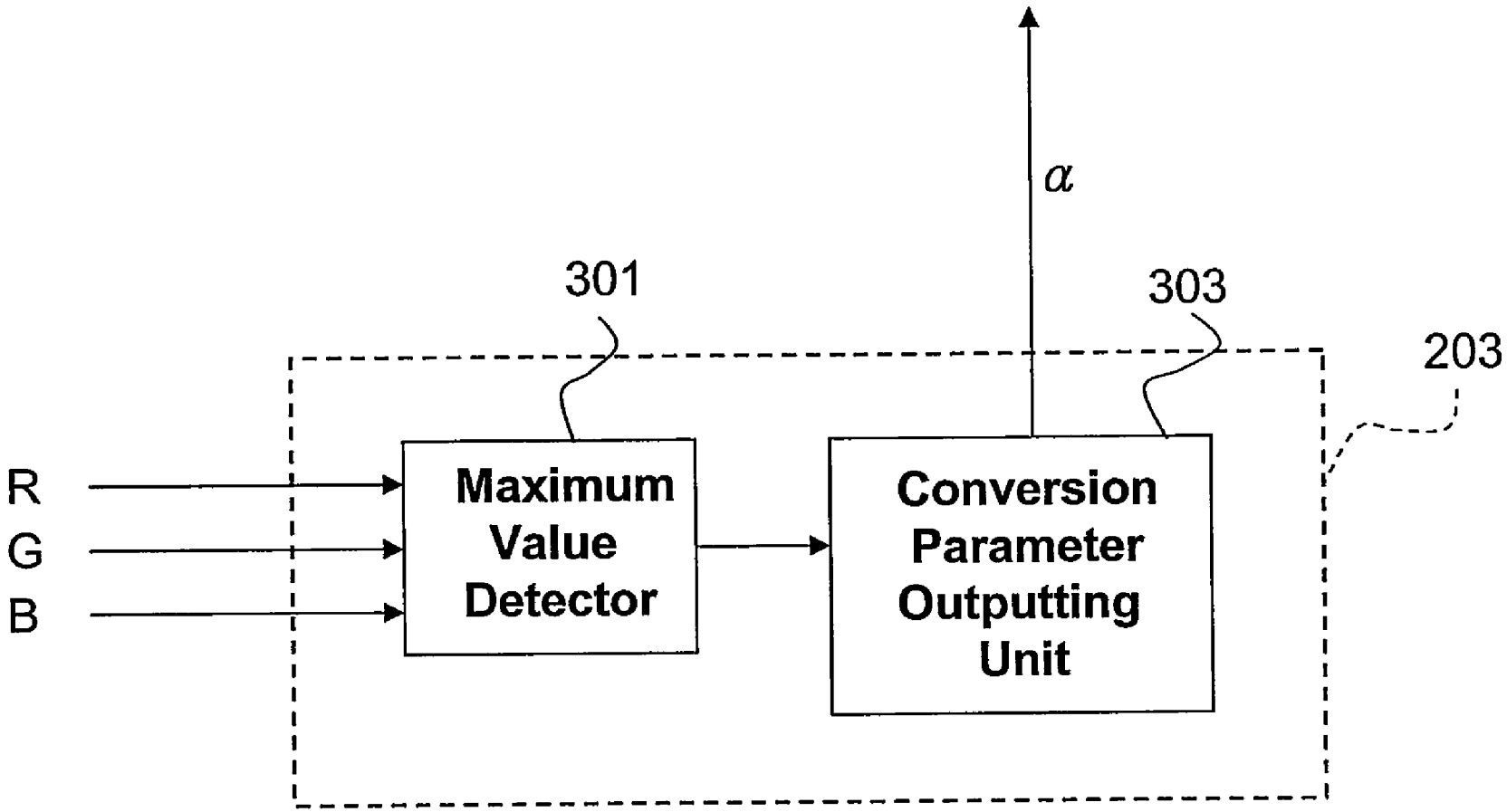
FIG. 3 is a block diagram of the non-linear converter in accordance with the second embodiment of the present invention.

The block diagram of the non-linear converter 203 is shown in FIG. 3. The non-linear converter 203 comprises a maximum value detector 301 and a conversion parameter outputting unit 303. The maximum value detector 301 finds a maximum value from the primary signal components R, G and B. The conversion outputting unit 303 will generate the conversion parameter α by, for example, using the formula, $\alpha=[UP/MAX]^{\beta}$, wherein MAX is the maximum value found from the maximum value detector 301; UP is the upper limit of the primary signal components, for example, 255; and β is a predetermined coefficient, ranging from 0 to 1 and preferred 0.5.

The conversion parameter outputting unit 303 in FIG. 3 may be implemented by a look-up table (LUT) with a predetermined coefficient β. The LUT provides a one-to-one mapping of its input value from the maximum value detector 301 and its output value, the conversion parameter α. Or the conversion parameter outputting unit 303 may be implemented by multiple look-up tables, each with a different coefficient β. Different coefficients β may be used by multiple LUTs to provide greater flexibility for designers to choose one LUT from multiple LUTs to output the conversion parameter α.

The conversion parameter outputting unit 303 in FIG. 3 may also be implemented by a microprocessor. The microprocessor may calculate the conversion parameter α. The value of the predetermined coefficient β may be changed by designers easily to provide even greater flexibility.

FIG. 4*a*~4*c* show the values of the primary signal components R, G and B of the input color signal, the adjusted primary signal components R", G" and B" and the white signal component W at different processing stages in an image processing device in accordance with the second embodiment of the present invention. In FIG. 4*a*, the values of the primary signal components R, G and B are shown, as an example, and the value of the white signal component W is set to be the same as the value of the primary signal component G, the one with the minimum value among the primary signal components R, G and B. In FIG. 4*b*, each of the primary signal components is multiplied by the conversion parameter α to produce αR, αG, and αB. In FIG. 4*c*, the values of the adjusted primary signal components R", G" and B" are shown, wherein R"=αR−W, G"=αG−W, and B"=αB−W. The value 255 on the vertical axis represents the upper limit UP of the primary signal components.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A method for image processing, comprising steps of:

figuring a maximum value of brightness from primary signal components of an input color signal;

appraising a coefficient;

generating a conversion parameter based on the maximum value, the coefficient and a greatest limitation of brightness of the primary signal components, wherein the conversion parameter is referred to as α, and if MAX, β and UP represent the maximum value of brightness, the coefficient and the greatest limitation of brightness, the conversion parameter is expressed by $\alpha=[UP/MAX]^{\beta}$;

extracting a white signal component from the primary signal components; and generating adjusted primary signal components of a display signal according to the conversion parameter, the white signal component and the primary signal components.

2. The method of claim 1, wherein the step of generating the conversion parameter includes steps of:

looking up the conversion parameter corresponding to the maximum value.

3. The method of claim 1, wherein the step of extracting the white signal component includes a step of finding a minimum value from the primary signal component as the white signal component.

4. The method of claim 1, wherein the step of generating the display signal includes a step of subtracting the white signal component from a multiplication result of the conversion parameter and the corresponding primary signal components.

5. The method of claim 1, wherein the primary signal components include red, green and blue signal components, and the step of generating the display signal includes steps of:

subtracting the white signal component from a multiplication result of the conversion parameter and the red signal component;

subtracting the white signal component from a multiplication result of the conversion parameter and the green signal component; and subtracting the white signal component from a multiplication result of the conversion parameter and the blue signal component.

6. The method of claim 1, wherein the primary signal component includes color signals R, G and B; the white signal component is referred to as W; and adjusted primary signal components R", G" and B" of the display signal are expressed by R"=α*R−W, G"=α*G−W; and B"=α*B−W.

7. The method of claim 6, wherein the step of generating the conversion parameter includes steps of:

looking up the conversion parameter corresponding to the maximum value.

8. The method of claim 6, wherein the step of extracting the white signal component includes a step of reckoning a minimum value from the primary signal component as the white signal component.

9. A device for image processing, comprising:

a white signal generator, generating a white signal component from primary signal components of an input color signal;

a non-linear converter, outputting a conversion parameter (a) according to a maximum value of brightness, a coefficient and a greatest limitation of brightness of the primary signal components, wherein the conversion parameter is referred to as α, and if MAX, β and UP represent the maximum value of brightness, the coefficient and the greatest limitation of brightness, the conversion parameter is expressed by $\alpha=[UP/MAX]^{\beta}$;

a multiplier, multiplying the primary signal components with the conversion parameter as a multiplication result; and a subtracting unit, subtracting the white signal component from the multiplication result as adjusted primary signal components of a display signal, the display signal further including the white signal component.

10. The device of claim 9, wherein the non-linear converter includes:

a maximum detector, detecting the maximum value from the primary signal components; and a conversion parameter outputting unit, outputting the conversion parameter according to the maximum value, the coefficient and the greatest limitation.

11. The device of claim 10, wherein the conversion parameter outputting unit includes a microprocessor or a lookup table.

12. The device of claim 9, wherein the white signal generator includes a minimum detector for detecting a minimum value from the primary signal components as the white signal component.

* * * * *